US007028747B2

(12) United States Patent
Widrig et al.

(10) Patent No.: US 7,028,747 B2
(45) Date of Patent: Apr. 18, 2006

(54) CLOSED LOOP STEAM COOLED AIRFOIL

(75) Inventors: Scott M. Widrig, Hobe Sound, FL (US); Ronald J. Rudolph, Juno Beach, FL (US); Gregg P. Wagner, Apopka, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 143 days.

(21) Appl. No.: 10/308,280

(22) Filed: Dec. 3, 2002

(65) Prior Publication Data

US 2003/0133799 A1 Jul. 17, 2003

Related U.S. Application Data

(62) Division of application No. 09/867,166, filed on May 29, 2001, now Pat. No. 6,511,293.

(51) Int. Cl.
*B22C 9/10* (2006.01)

(52) U.S. Cl. ..... 164/369; 164/516; 164/368

(58) Field of Classification Search ..... 164/516, 164/369, 368, 122.1, 122.2; 415/115, 114, 415/116

See application file for complete search history.

(56) References Cited

U.S. PATENT DOCUMENTS

| | | | | |
|---|---|---|---|---|
| 5,320,483 | A | 6/1994 | Cunha et al. | |
| 5,340,274 | A * | 8/1994 | Cunha | 415/115 |
| 5,473,898 | A | 12/1995 | Briesch | |
| 5,536,143 | A | 7/1996 | Jacala et al. | |
| 5,758,487 | A | 6/1998 | Salt et al. | |
| 5,813,827 | A * | 9/1998 | Nordlund et al. | 415/115 |
| 5,853,044 | A * | 12/1998 | Wheaton et al. | 164/516 |
| 5,950,705 | A * | 9/1999 | Huang | 164/137 |
| 6,145,295 | A | 11/2000 | Donovan et al. | |
| 6,416,275 | B1 * | 7/2002 | Itzel et al. | 415/116 |
| 6,454,526 | B1 * | 9/2002 | Cunha et al. | 415/115 |
| 6,506,013 | B1 * | 1/2003 | Burdgick et al. | 415/115 |
| 6,530,416 | B1 * | 3/2003 | Tiemann | 164/137 |
| 6,557,621 | B1 * | 5/2003 | Dierksmeier et al. | 164/369 |

FOREIGN PATENT DOCUMENTS

| | | |
|---|---|---|
| EP | WO 98/25009 | 6/1998 |
| EP | WO 99/06166 | 2/1999 |

* cited by examiner

*Primary Examiner*—Len Tran

(57) ABSTRACT

An airfoil, a method of manufacturing an airfoil, and a system for cooling an airfoil is provided. The cooling system can be used with an airfoil located in the first stages of a combustion turbine within a combined cycle power generation plant and involves flowing closed loop steam through a pin array set within an airfoil. The airfoil can comprise a cavity having a cooling chamber bounded by an interior wall and an exterior wall so that steam can enter the cavity, pass through the pin array, and then return to the cavity to thereby cool the airfoil. The method of manufacturing an airfoil can include a type of lost wax investment casting process in which a pin array is cast into an airfoil to form a cooling chamber.

9 Claims, 4 Drawing Sheets

CLOSED LOOP STEAM COOLED AIRFOIL

This application is a divisional application of U.S. application Ser. No. 09/867,166, filed May 29, 2001, now U.S. Pat. No. 6,511,293 and claims priority thereto.

GOVERNMENT RIGHTS STATEMENT

This invention was conceived under United States Department of Energy Contract DE-AC05-00 OR22725. The United States Government has certain rights hereunder.

FIELD OF THE INVENTION

The present invention relates in general to an airfoil, a method of manufacturing an airfoil, and a system for cooling an airfoil, and, more particularly, to a thin walled pin array cast airfoil cooled through a closed loop steam cooling scheme that is located in the first stages of a combustion turbine within a combined cycle power generation plant.

BACKGROUND OF THE INVENTION

Many power generation plants produce electricity by converting energy (e.g. fossil fuel, nuclear fusion, hydraulic head and geothermal heat) into mechanical energy (e.g. rotation of a turbine shaft), and then converting the mechanical energy into electrical energy (e.g. by the principles of electromagnetic induction).

Some of these power generation plants, such as a fossil fuel power generation plant, comprise a turbine and a generator. The turbine converts fossil fuel energy into mechanical energy in the form of turbine shaft rotation through a steam or combustion cycle. In a steam cycle, fuel (e.g. coal) is burned in a boiler to produce a steam force that is introduced into a steam turbine. The steam force works to turn stages of airfoil blades that are attached to and rotate a shaft. Corresponding stages of stationary airfoil vanes help direct the steam force over the blades. In a combustion cycle, compressed air and fuel (e.g. oil or natural gas) are mixed and burned in a combustion section of a combustion turbine to produce a combustion force that works to turn the stages of airfoil blades. In either cycle, fossil fuel energy is ultimately converted into mechanical energy in the form of turbine shaft rotation. It is known to use both a steam cycle and a combustion cycle to increase power generation plant efficiency in what is commonly termed a combined cycle power generator plant. Such combined cycle power generator plants are described in U.S. Pat. Nos. 4,932,204, 5,255,505, 5,357,746, 5,431,007, 5,697,208 and 6,145,295, each of which is hereby incorporated by reference in their entirety.

One aspect of the above-described power generation scheme involves the cooling of turbine airfoil blades and vanes. In order to maximize power generation plant efficiency, gas turbine inlet temperatures can attain temperatures of about 2600° F. or higher. These high temperatures, however, can melt or otherwise harm the turbine airfoils, especially those in the first stages. A coolant is therefore used to inhibit airfoil melting, cracking, creeping, oxidizing or other failure by maintaining the airfoil temperature at about 1700–2000° F. or less. The cooling scheme is advantageously incorporated into the airfoil configuration itself.

Turbine airfoils are typically cooled through one of two types of cooling schemes, commonly termed open loop and closed loop. An open loop scheme is generally used in a combustion cycle due to the ready availability of air. In an open loop scheme, compressed air is bled from the compressor section of the combustion turbine. The compressed air is directed through inlet passages of an airfoil within the combustion section of the combustion turbine, and then into the airfoil cavity. This cooling air then travels from the airfoil cavity, along a cooling passage, and exits the airfoil via outlet passages. The outlet passages direct the cooling air along the exterior wall of the airfoil. By this configuration, the airflow cools the airfoil interior by impingement and convection currents and cools the airfoil exterior by film flow.

A disadvantage of this open loop cooling scheme, however, is that extracting coolant air from the compressor section causes parasitic losses to the thermodynamic efficiency of the power generation plant. Another disadvantage of open loop cooling is that air has a relatively low latent specific heat and is therefore relatively inefficient at absorbing heat to thereby cool the airfoil.

A closed loop cooling scheme can be used to overcome several disadvantages of open loop cooling. A closed loop scheme is generally used in a steam cycle due to the ready availability of steam. In closed loop cooling, steam from the steam turbine and/or a heat recovery steam generator (HRSG) is directed through inlet passages of an airfoil within the steam turbine, and then into the airfoil cavity. This cooling steam then circulates from the airfoil cavity, along a cooling passage, and then back into the airfoil cavity. The now warmed used coolant steam is then removed from the cavity and replaced with new coolant steam.

Although a closed loop scheme is generally preferable to an open loop scheme because steam has a higher latent specific heat than air, one disadvantage of closed loop cooling is that is the steam must be provided at a relatively high pressure (about 500–1000 psi, which is about 3–5 times greater than the air pressure used in an open loop system). This high pressure, as well as thermal stresses, place severe stresses on the airfoils and require that the airfoils have a relatively strong construction. Also, it is difficult and expensive to manufacture a suitably strong thin walled airfoil. It has been thus been found useful to use an airfoil having internal ribs to provide relative strength and assist in cooling.

Conventional steam cooled airfoils having internal cooling passages are typically made by welding discrete perforated inserts between the perimeter wall of the airfoil cavity and the exterior wall of the airfoil. The perforated inserts have a dimension that maintains a distance between the airfoil cavity and the airfoil exterior wall so that coolant steam can pass through the airfoil cavity, through the perforated insert, and then back into the airfoil cavity to provide impingement cooling. The perforated inserts are typically machined by steel rolling, which can be difficult and expensive. Moreover, this approach exceeds the available steam pressure drop and generates degraded impingement HTCs due to inherent crossflow effects.

There is thus a need for an improved airfoil cooling scheme. There is also a need for an airfoil that can be cooled in an improved manner. There is a further need for an improved process for manufacturing an airfoil that requires cooling. There is also a need for a thin walled pin array cast airfoil that is cooled through a closed loop steam cooling scheme which is located in the first stages of a combustion turbine within a combined cycle power generation plant.

SUMMARY OF THE INVENTION

The present invention provides a method for cooling an airfoil by flowing steam through a pin array set within the airfoil wall. The present invention also provides a cavitied airfoil having a cooling chamber bounded by an interior wall and an exterior wall so that steam can enter the cavity, pass through the cooling chamber, and then return to the cavity to thereby cool the airfoil. The present invention also provides a method of manufacturing the airfoil using a type of lost wax investment casting process in which a pin array is cast directly into an airfoil to set it therein as a single piece casting to form a cooling chamber. The present invention also provides a thin walled pin array cast airfoil that is cooled through a closed loop steam cooling scheme which is located in the first stages of a combustion turbine within a combined cycle power generation plant.

One aspect of the present invention thus involves an airfoil, comprising, an outer wall; an inner wall bounding a cavity; and a cooling chamber at least partially disposed between the inner wall and the outer wall, the cooling chamber having a plurality of pins extending from a portion of the cooling chamber. Wherein, steam can enter the cavity, advance through at least a portion of the cooling chamber to thermally contact at least one pin and return to the cavity, and then exit the airfoil.

Another aspect of the present invention involves a method of cooling an apparatus, comprising, providing an apparatus having a cavity at least partially bounded by a wall and a cooling chamber thermally connected to the wall, the cooling chamber including a plurality of pins that extend from a portion of the wall; passing a fluid through the cavity and into the cooling chamber so that the fluid thermally contacts the pins and thermally contacts the wall; and returning the fluid from the cooling chamber to the cavity.

Another aspect of the present invention involves a method of manufacturing a cast airfoil, comprising, attaching an array core to a main core; covering the main and array cores with wax to form an assembly; removing the wax from the assembly to form cavities within the assembly; placing metal in the cavities; and removing the main and array cores to form the cast airfoil.

Further aspects, features and advantages of the present invention will become apparent from the drawings and detailed description of the preferred embodiment that follows.

BRIEF DESCRIPTION OF THE DRAWINGS

The above-mentioned and other concepts of the present invention will now be addressed with reference to the drawings of the preferred embodiment of the present invention. The illustrated embodiment is intended to illustrate, but not to limit the invention. The drawings contain the following figures, in which like numbers refer to like parts throughout the description and drawings and wherein.

DETAILED DESCRIPTION OF THE PREFERRED EMBODIMENT

The invention described herein employs several basic concepts. For example, one concept relates to a method for cooling an airfoil located in the first stages of a combustion turbine within a combined cycle power generation plant by flowing closed loop steam through a pin array set within an airfoil. Another concept relates to a cavitied airfoil having a cooling chamber bounded by an interior wall and an exterior wall so that steam can enter the cavity, pass through the pin array, and then return to the cavity to thereby cool the airfoil. Yet another concept relates to a method of manufacturing an airfoil manufactured by a type of lost wax investment casting process in which a pin array is cast into an airfoil to form a cooling chamber. These exemplary concepts are intended to assist the reader in understanding some aspects of the present invention and are not intended to define or limit the scope of the present invention.

The present embodiment of the invention is disclosed in context of use with an airfoil located in the first stages (i.e. stages 1–3) of a combustion turbine in a combined cycle power generation plant that is cooled via a closed loop steam cooling scheme. The principles of the present invention, however, are not limited to airfoils in the first stages of combustion turbines or to closed loop steam cooling schemes. Instead, it will be understood by one skilled in the art, in light of the present disclosure, that the present invention disclosed herein can be successfully utilized in connection with turbine components other than first stages of airfoils that need to be cooled, such as with other stages of airfoils, transitions sections and the like. It will be also understood by one skilled in the art, in light of the present disclosure, that the present invention disclosed herein can be successfully utilized in connection with cooling mediums other than closed loop steam, such as air, hydrogen, open loop schemes and the like. One skilled in the art may also find additional applications for the airfoil cooling method, airfoil, and airfoil manufacturing method disclosed herein, such as with other power generation cooling schemes, engines and the like. Thus, the illustration and description of the airfoil cooling method, airfoil, and airfoil manufacturing method of the present invention in connection with an exemplary closed loop steam cooling scheme used in a combined cycle power generation plant is merely one possible application of the present invention. However, the present invention has been found particularly suitable in connection with an airfoil located in the first stages of a combustion turbine within a combined cycle power generation plant that is cooled via a closed loop steam cooling scheme.

Figure 2:
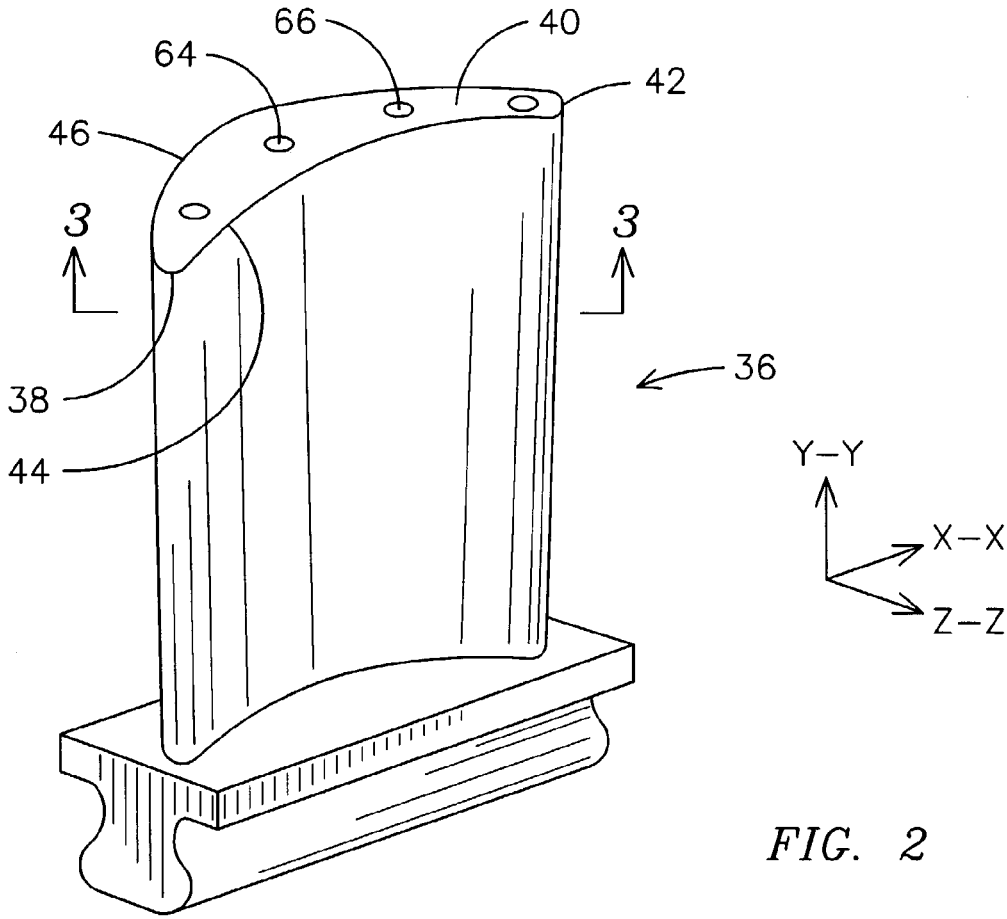
FIG. 2 is a perspective view of an exemplary airfoil in accordance with the present invention.

To assist in the description of the invention described herein, the following terms are used. Referring to FIG. 2, a "longitudinal axis" (X—X) extends along the major axis length of the airfoil. A "lateral axis" (Z—Z) extends along the minor axis length of the airfoil. A "transverse axis" (Y—Y) extends normal to both the longitudinal and lateral direction, and provides the third or depth dimension of the airfoil. In addition, as used herein, the "longitudinal direction" refers to a direction substantially parallel to the longitudinal axis, the "lateral direction" refers to a direction substantially parallel to the lateral axis, and the "transverse direction" refers to a direction substantially parallel to the transverse axis. In addition, "spanwise" and "chordwise" are used to describe relative direction, with "spanwise" describing a direction that is radial to the airfoil and "chordwise" describing a direction that is axial to the airfoil. Thus, steam flow that is spanwise moves in a direction that is radial to or within the airfoil, and steam flow that is chordwise moves in a direction that is axial to or within the airfoil.

Combined Cycle Power Generation Scheme Using Closed Loop Steam Cooling

Figure 1:
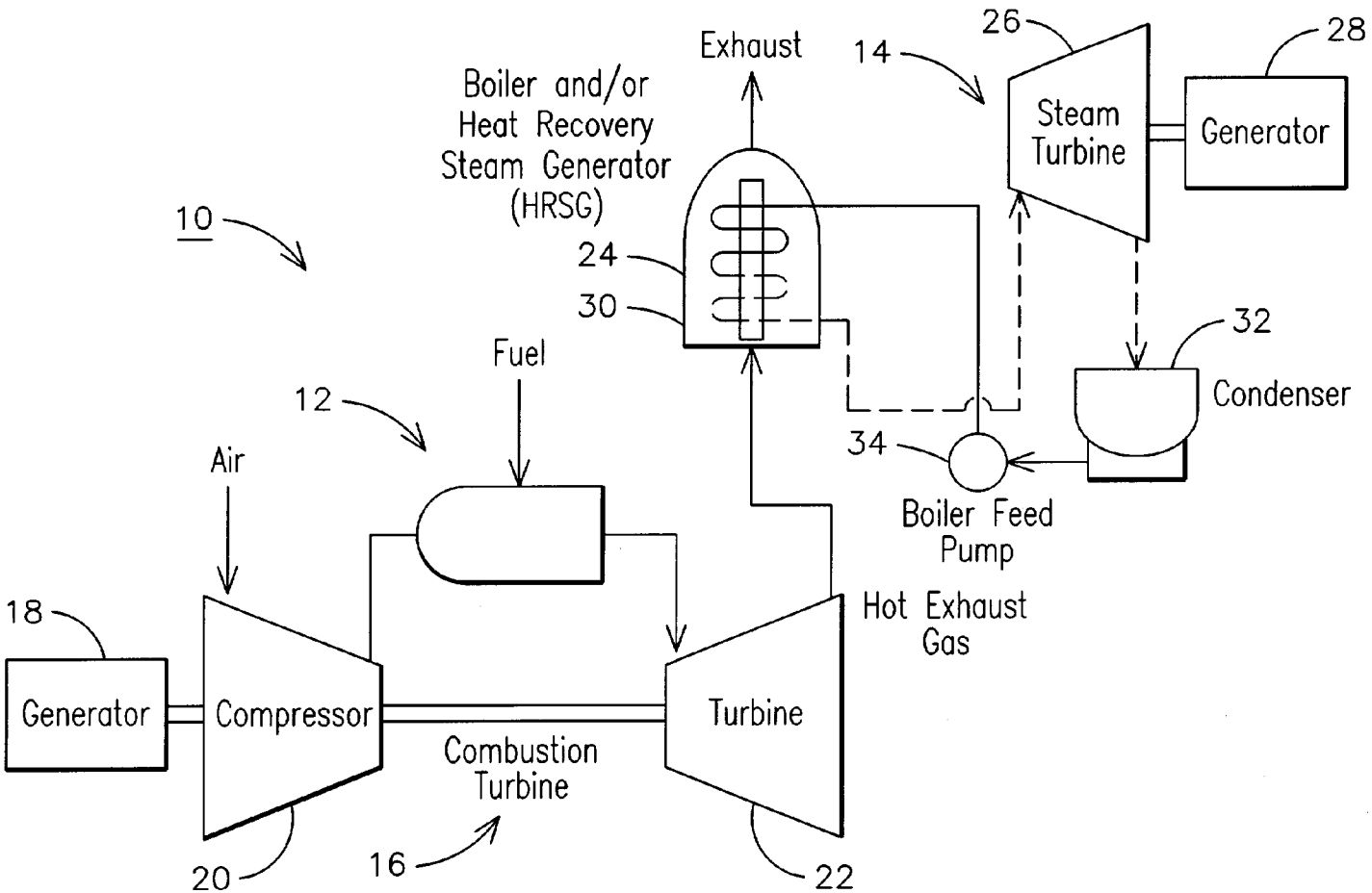
FIG. 1 is a schematic diagram of a combined cycle power generation plant, showing a cooling scheme for steam cooling turbine airfoils of the present invention.

With reference now to FIG. 1, an exemplary combined cycle power generation plant 10 that uses a closed loop steam cooling scheme is shown. The combined cycle power generation plant 10 uses both a combustion cycle 12 and a steam cycle 14. The components used in connection with the combustion cycle 12 include a combustion turbine 16 operatively connected to a generator 18. The combustion turbine 16 has a compressor portion 20 where ambient intake air is compressed, and a turbine portion 22 where the ignited mixture of compressed air and fuel is worked. The components used in connection with the steam cycle 14 includes a boiler 24 and a steam turbine 26 operatively connected to a generator 28 (the generator 28 may alternatively be the same generator as generator 18). The boiler 24 converts water to steam and directs the steam to the steam turbine 26 where it is worked.

The combined cycle power generator plant advantageously includes a heat recovery steam generator "HRSG" 30 to increase plant efficiency. The HRSG 30 receives hot exhaust gas from the turbine portion 22 of the combustion turbine 16 and converts that hot exhaust gas into working steam. The working steam is then sent to the steam turbine 26. The illustrated embodiment shows the boiler 24 and HRSG 30 as one individual component, however, the boiler 24 and HRSG 30 may comprise distinct components. The HRSG steam turbine can be divided into low pressure (LP), intermediate pressure (IP), and high pressure (HP) sections (not shown).

The combined cycle power generator plant further includes a condenser 32. The condenser 32 receives exhaust steam from the steam turbine 26 and condenses that steam into water. The water is then sent back into the boiler 24 and/or HRSG 30 via a boiler feed pump 34 or similar apparatus.

By this and equivalent combined cycle power generation plant configurations, power plant efficiency is increased through the use of the otherwise unused hot exhaust gas from the combustion turbine 16 to create working steam for use in the steam turbine 26.

Airfoil

Figures 3, 5:
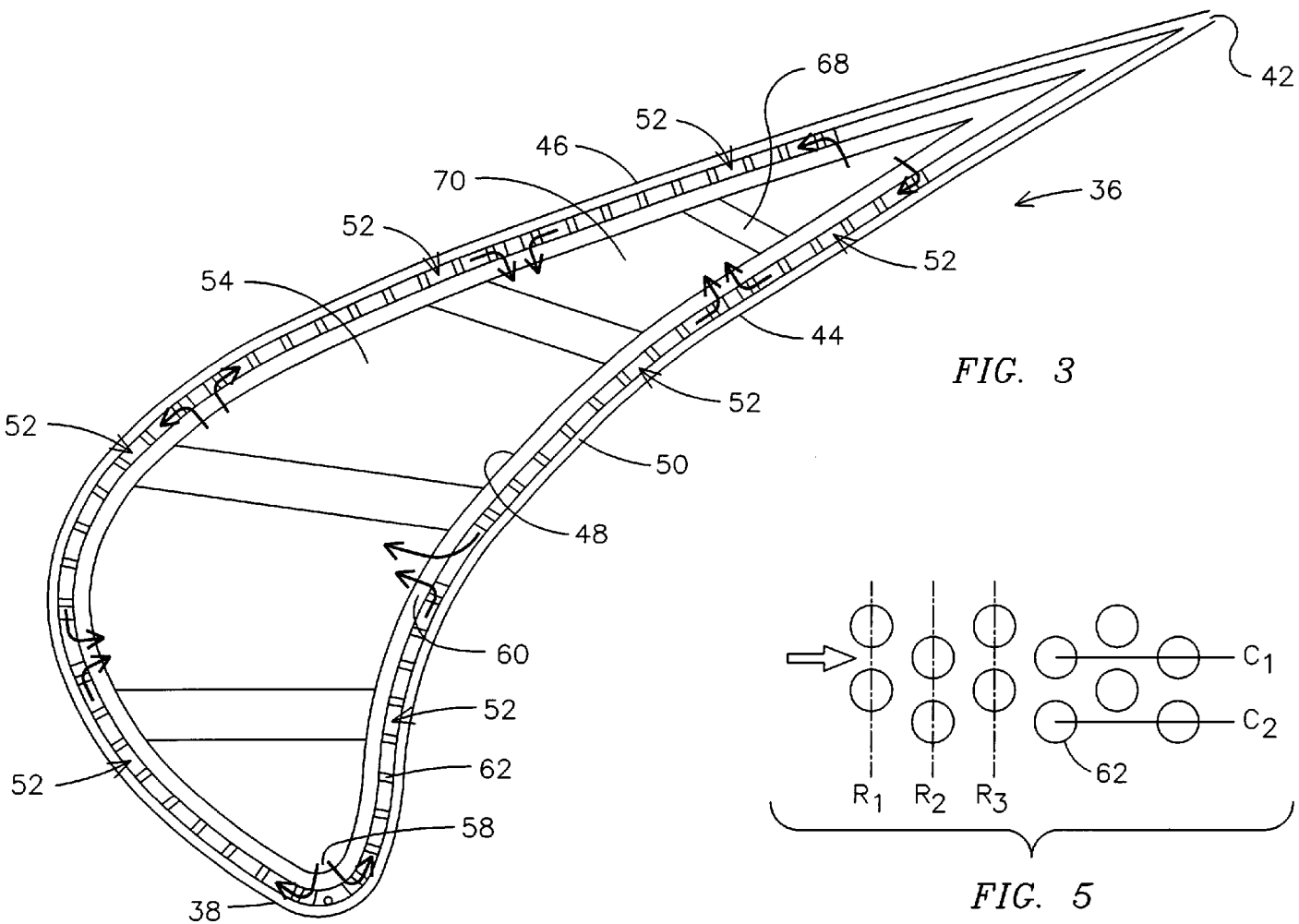
FIG. 3 is a cutaway side elevation view of the airfoil of FIG. 2 taken along cut line 3—3, showing additional airfoil components and a flow of cooling steam.
FIG. 5 is a detail view of an exemplary arrangement of pins located within the cooling chamber.

With reference now to FIGS. 2 and 3, an exemplary airfoil 36 is shown. The airfoil 36 extends in the longitudinal direction (X—X) from a leading edge 38 over an airfoil body region 40 to a trailing edge 42. The airfoil 36 extends in the lateral direction (Z—Z) from a concave or pressure side 44 over the airfoil body region 40 to a convex or suction side 46. The airfoil 36 advantageously includes an outer wall 48, an inner wall 50, at least one cooling chamber 52, and at least one cavity 54, as described below.

The outer wall 48 is advantageously constructed as thin a possible in order to maximize its heat transfer function, taking into consideration the internal to external pressure loading of about 100–500 psi that it must withstand when used in the first stages of a combustion turbine 16 and depending upon the material from which it is constructed. A suitable outer wall 48 thickness is preferably about 2 mm to about 0.15 mm, more preferably about 1 mm, but can exceed this range.

The outer wall 48 need not have a uniform thickness, and it may be advantageous to use an outer wall 48 having a nonuniform thickness. For example, since the coolant steam is coolest at the inlet 58 and hottest at the outlet 60, if a constant outer wall 48 thickness is used, the portion of the outer wall 48 near the coolant steam inlet 58 tends to become overcooled while the portion of the outer wall 48 near the coolant steam outlet 60 tends to become undercooled. To account for this, a tapered, stepped or otherwise nonuniform outer wall 48 can be used. An outer wall having a uniform taper of about 1° to about 5° from the inlet 58 to the outlet 60 has been found suitable for this purpose.

The inner wall 50 advantageously has a thicker construction than the outer wall 48 to withstand aerodynamic loading forces and to withstand airfoil creep. A suitable inner wall 50 thickness is preferably about 0.01 mm to about 0.15 mm and more preferably about 0.04 mm to about 0.09 mm, but can exceed this range. Like the outer wall 48, the inner wall 50, need not have a uniform thickness.

The thickness of the walls 48, 50 should also advantageously take into consideration low cycle fatigue, which tends to cause the outer wall 48 to expand more and faster than the inner wall 50 during steam turbine 26 startup and operation, and thus flatten-out the otherwise arced outer wall 48. The above wall thicknesses suitably take this low cycle fatigue into consideration.

Still referring to FIG. 3, the illustrated airfoil 36 shows six cooling chambers 52, with three arranged on the pressure side 44 and three arranged on the suction side 46. This arrangement has been found suitable in balancing cost and performance considerations, since cooling effectiveness tends to increase with additional cooling chambers 52 but so does manufacturing costs. The number of cooling chambers 52, however, can easily vary from about 1 to about 100 or more, and there is no need for symmetry between the pressure and suction sides 44, 46. Each cooling chamber 52 has at least one inlet 58 and at least one outlet 60, and a plurality of heat transmission elements or pins 62 disposed between an inlet 58 and outlet 60.

Although the illustrated airfoil 36 shows each cooling chamber 52 having one inlet 58, it may be is advantageous to use a plurality of inlets to parallely feed a common supply plenum in order to reduce the drop in steam coolant pressure between cooling chamber 52 inlet 58 and outlet 60. This pressure drop should be taken into consideration because the pressure at the outlet 60 should be greater than the intermediate steam turbine 26 pressure in order to for the steam to return to the combined power cycle.

Figure 4:
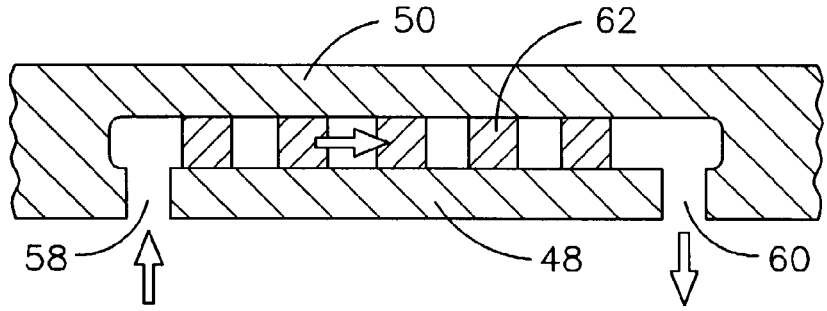
FIG. 4 is a detail view of an exemplary cooling chamber of the airfoil, showing the flow of cooling steam therethrough.

Referring to FIGS. 3 and 4, each inlet 58 may be formed along an axis that is generally perpendicular to the outer wall 48, although the inlet 58 can take on a variety of other sizes and shapes. For example, the inlet 58 can have a perimeter that is generally circular, oval, square, rectangular, polygonal, curved, curvilinear, combinations thereof and the like. The inlet 58 can also have a cross section that is generally uniform, tapered, stepped, combinations thereof and the like. For the present exemplary airfoil application, it has been found suitable to use a generally circular inlet 58 with a uniform cross section (i.e. tubular shaped). If a tubular shaped inlet 58 is used, a minimum diameter of about 2 mm to about 3 mm has been found suitable. The inlets 58 need not be configured in the same manner.

The cooling chamber 52 can be advantageously arranged to provide a chordwise direction steam cooling flow within the airfoil cavity 54, alternatively, the cooling chamber 52 can be arranged to provide a radial direction convection steam cooling flow. If a radial flow is used, the cooling chamber 52 should have a larger cross section to strengthen the ceramic cores. The outlet 60 is advantageously configured in a manner similar to the inlet 58, and preferably configured in the same manner.

Referring to FIGS. 4 and 5, the pins 62 advantageously extend from the outer wall 48 to the inner wall 50 of the cooling chamber 52. The pins 62, however, could be arranged to extend from the outer wall 48 and/or inner wall 50 toward the opposing wall 48 or 50, or from the floor or ceiling of the cooling chamber 52, or from an intermediary wall, ledge or other component. Depending on the airfoil cooling requirements and steam pressure, the pins 62 could extend a length of anywhere from just slight off a wall 48, 50 (i.e. about 0.1 mm out from a wall 48, 50) to all the way to the opposing wall 48, 50 (i.e. thermally connecting the outer and inner walls 48, 50 and forming a laterally extending barrier across the cooling chamber 52). The pins 62 need not extend the same dimensional amount. For purposes of the present exemplary airfoil application, it has been found suitable to use pins 62 that thermally connect the outer and inner walls 48, 50 and form a laterally extending barrier across the cooling chamber 52.

The pins 62 can take on a variety of sizes and shapes, depending on the particular airfoil cooling requirements and steam pressure. For example, each pin 62 can have a perimeter that is generally circular, oval, square, rectangular, polygonal, curved, curvilinear, combinations thereof and the like. For example, the pins 62 can also have a cross section that is generally uniform, tapered, stepped, combinations thereof and the like. For the present exemplary airfoil application, it has been found suitable to use a generally circular pin 62 with a uniform cross section (i.e. column shaped). If column shaped pins 62 are used, a diameter of about 0.5 mm to about 2 mm has been found suitable. The pins 62 need not have the same configuration. The exterior surface of the pins 62 advantageously are generally smooth to assist the steam flow.

The pins 62 can be arranged in any of a variety of configurations, depending on the airfoil cooling requirements, steam pressure. For example, the pins 62 can be arranged in rows R (e.g. $R_1$, $R_2$), with each row having one or more of pins 62. For another example, the pins can be arranged in columns C (e.g. $C_1$, $C_2$), with each column C having one or more pins 62. For another example, the pins 62 can be arranged in a staggered geometric or random pattern along all or a portion of the cooling chamber 52. For purposes of the exemplary illustrated airfoil, it has been found suitable to configure the pins 62 in geometrically uniform arrays, with each array having about 2 to 20 rows and preferably about 7 to about 13 rows, and about 2 to 20 columns and preferably about 5 to about 10 columns. Further, the pins 62 can be arranged with different distances between each pin 62 or with different distances between rows and/or columns of pins 62, or with random distances between pins 62. It has been found suitable to arrange the pins 62 with a uniform distance of about 2 mm to about 5 mm between each row and preferably about 2 mm to about 5 mm between each column.

Variations in the size, shape, configuration, diameter and spacing of the pins 62 (as well as the cooling chamber 52 area itself) can be used to alter, modify and/or control one or more characteristics or properties of the coolant airflow. For example, velocity through the cooling chamber 52 can be decreased by increasing the spacing between pins 62 and/or decreasing the diameter of the pins 62. For another example, heat transfer convection along an area slightly beyond the inlet 58 may be decreased by increasing pin spacing. For another example, convection along an area slightly before the outlet 60 may be increased by decreasing pin spacing.

Also, pin 62 variations can maximize the convective heat transfer coefficient (HTC) as the steam flow transitions away from inlet 58 affects. Variation in spacing can produce coolant velocities to keep the internal HTC to maintain a constant hot sheet heat flux. This constant heat flux from the hot wall results in reduced in-plane thermal gradients with the plane of the hot sheet and reduced thermal stresses. Steam coolant replenishment holes can also be incorporated at various distances into the array to maintain high coolant to gas temperature differences and high heat transfer rates.

Referring back to FIGS. 2 and 3, the cavity 54 is defined by the inner wall 48 and has at least one intake 64 from which the cooling steam enters the airfoil 36 and at least one exhaust 66 from where the warmed used steam exits the airfoil 36. The cavity may also include one or more support ribs 68. Although the illustrated ribs 68 run transversely across the cavity 54 to partition the cooling chamber 52 into sections 70 within which the cooling steam flows in convective currents and assists in impingement cooling of the inner wall 48, there is no requirement this particular configuration be used.

The external hot sheet airfoil thermal compressive stresses are a function of (1) the bulk average temperature difference between the hot and cold walls, (2) the spacing between pedestals and (3) pedestal height. Reducing the spacing between pedestals or increasing the length of the pedestals can lower this stress and can be considered during the pin array layout to optimize both heat transfer effects and the resulting thermal stresses. An area of thick wall would result between each array panel that produces an overall airfoil stiffening effect to reduce bulk (creep) stresses in the center of a vane airfoil.

The airfoil 36 can be made of any of a variety of compositions, such as metals, alloys, ceramics, composites and the like. Preferably, the airfoil 36 is made of a high strength alloy due to its relative high strength, relative high temperature resistance, and relative low cost of high strength alloys. Suitable high strength alloys include IN939, MARM002, IN738, CM247, CMSX and the like. Most preferably, the airfoil comprises a high strength nickel material in the form of conventional equiax, directionally solidified (DS) or single crystal (SX) materials because of its high temperature material properties.

Airfoil Cooling Scheme

Referring now to FIGS. 1–3, in operation, in context of the exemplary closed loop steam cooling scheme, cooling steam enters the airfoil 36 cavity 54 via the intake 64. The steam then advances through the cooling chambers 52, thermally contacts the walls 48, 50 and cooling pins 62, and then returns to the cavity 54. After returning to cavity 54, the steam exits the airfoil 36 cavity 54 via the exhaust 66. By this configuration, the coolant steam cools the airfoil 36 by convective and impingement cooling of the cavity 54, walls 48, 50 and pins 62.

As previously described, the steam source advantageously is exhaust steam from the combustion turbine 16 and/or HRSG 30, although other steam sources can be used. Also, if the steam flow through a cavity 54 having partitioning ribs 68, the steam need not enter into and exit from the same partition 70.

Method of Manufacturing the Airfoil

Figure 6:
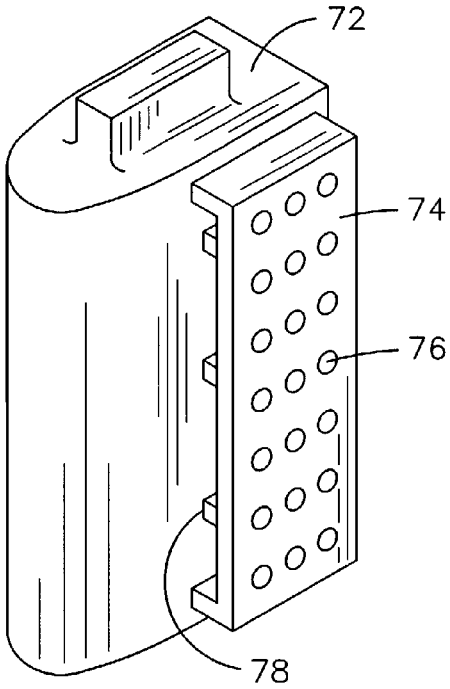
FIG. 6 is a perspective view of a partially manufactured airfoil, showing an array core attached to a main core.

With reference to FIGS. 3 and 6, the airfoil 36 is advantageously manufactured using a casting technique. Use of a casting technique provides several advantages such as increased airfoil cooling effectiveness and decreased airfoil manufacturing costs. For example, casting provides significant flexibility when forming the cooling chambers 52, which is advantageous when the airfoil 36 has an intricate pin 62 configuration such as those described above. For another example, casting allows the outer and inner walls 48, 50 to be constructed suitably thin, as described above. For another example, casting allows the airfoil 36 to be manufactured without filleting or otherwise opening a portion of the airfoil 36 in order to form the cooling chambers 52 between the outer and inner walls 48, 50. For another example, casting allows the airfoil 36 to be manufactured without using a bonding or brazed multi-piece assembly.

One suitable casting technique, described below, is a type of lost wax investment casting process. However, other casting techniques can be used. The illustrated exemplary casting technique advantageously involves the use of one or more main cooling cavity cores 72 having the general size and shape of the airfoil cavity 54; one or more pin fin cooling cavity array cores 74 having the general size and shape of the airfoil cooling chambers 52, inlets 58 and outlets 60; and wax 80 having the general size and shape of the outer and inner walls 48, 50, and, the pins 62.

Figure 7:
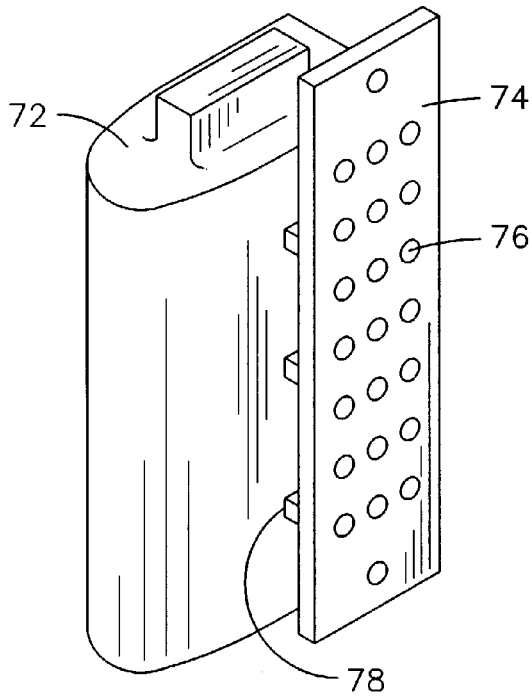
FIG. 7 is a perspective view of another partially manufactured airfoil, showing the array core attached to the main core in a different manner.
Figure 8:
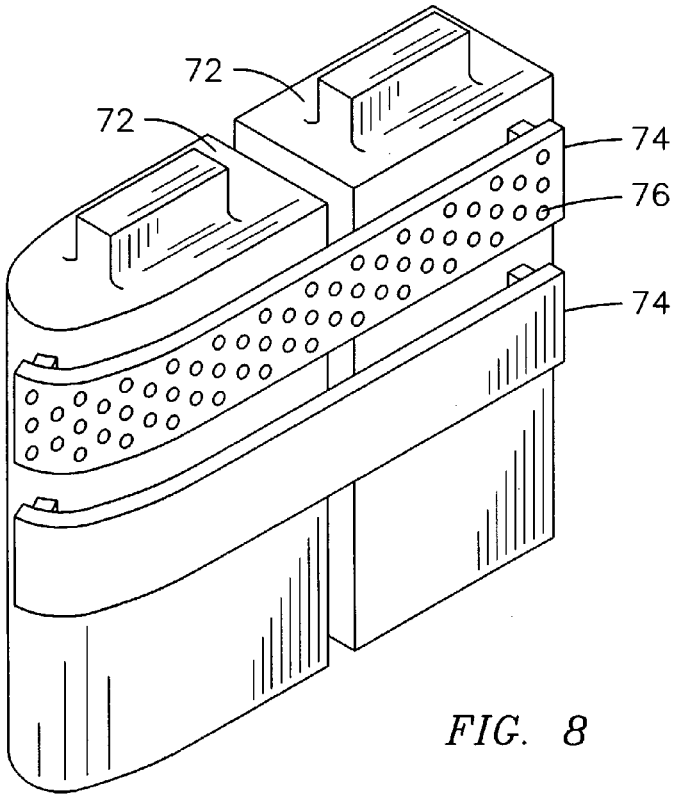
FIG. 8 is a cutaway perspective view of another partially manufactured airfoil, showing the array core attached to the main core in another different manner to provide for chordwise steam flow.

Referring to FIGS. 6–8, the main core 72 has the general size and shape of the airfoil cavity 54. The main core 72 should be capable of withstanding elevated temperatures and maintaining its size and shape throughout the casting process. A suitable main core 72 can be constructed of a ceramic material and the like.

The array core 74 is attached to the main core 72. The array cores 74 have the general size and shape of the airfoil cooling chambers 52, inlets 58 and outlets 60. Each array core 74 has a plurality of indentations or holes 76 that correspond in size and shape to the desired pins 62. The array core 74 should have capabilities similar to those of the main core 72 and can be constructed of a similar material.

The use of array cores 74 provides significant flexibility when forming the cooling chambers 52, which is advantageous when the airfoil 36 has an intricate pin 62 configuration such as those described above. For example, several array cores, each having the same size, shape, thickness, quantity, spacing and disposition of holes 76, can be used to construct a particular airfoil 36 cooling chamber 52 and pins 62. For another example, several array cores 74, each having a different size, shape, thickness, quantity, spacing and disposition of holes 76, can be mixed and matched to construct another particular cooling chamber 52 and pins 62. In this manner, an airfoil 36 having an intricate pin 62 configuration can be easily made. Similarly, airfoils 36 with different inlet 58 and outlet 60 configurations can also be easily made, as shown by FIGS. 6 and 7. FIG. 8 also exemplifies how the main and array cores can be attached to provide for a chordwise steam flow.

The array core 74 can be attached to the main core 72 by stabilizing rods or chaplets 78. Any number of chaplets 78 can be used. In general, the more chaplets 78 used, the more secure the attachment but the chaplets can leave a steam coolant leak path to the exterior of the airfoil walls which results in higher the manufacturing costs. It has been found suitable to use about 1 to about 20 chaplets to attach an array core 74 to a main core 72, and preferably about 4 to about 10 chaplets.

The array cores 72, 74 can be made from a ceramic slurry. The slurry is injected into a mold tool having the size and shape of the desired core 72, 74. The slurry is then subjected to a suitable temperature and pressure environment to convert the slurry into the desired core 72, 74.

After the array core(s) 74 are attached to the main core(s) 76, the cores 74 with the chaplets 76 are placed into a wax pattern tool. The wax pattern tool positions the cores relative to the airfoil to ensure the proper wall thickness.

Wax or other suitable material, preferably in liquid form, is then injected, immersed, or otherwise placed around and between the main and array cores 72, 74. The main and array cores 72, 74 are thereby covered, surrounded or buried by the wax. As stated above, the size and shape of the airfoil 36 outer and inner walls 48, 50, and pins 62 are determined by this wax configuration. The wax should be capable of maintaining its configuration during part of the casting process but dissolving when exposed to the casting process temperatures. By the above process, an airfoil wax pattern assembly is formed.

The airfoil wax pattern assembly is then covered with a ceramic shell by dipping the assembly into a liquid ceramic slurry. The slurry is then dried to form the ceramic shell. The ceramic shell is then heated to melt the wax portion of the pattern and thereby create a fired airfoil assembly. This heating process cures the ceramic and also liquefies the wax so that the wax can run-off and thereby be removed from the fired airfoil assembly. The fired airfoil assembly includes hollow cavities in the places where the removed wax formerly occupied. The cured ceramic main and array cores 72, 74, as well as the cured ceramic shell, remain in place. The fired airfoil assembly is allowed to cool, preferably to about room temperature. The wax melt out may be performed at the same time as the metal pouring.

The fired airfoil assembly is then placed into a furnace, such as a vacuum melt furnace. Liquid metal (or other material from which the airfoil 36 is constructed) is then poured into the furnace to bathe or otherwise cover the fired airfoil assembly. By this method, the liquid metal can fill the hollow cavities. The liquid metal is then allowed to cool and solidify. The solidified metal forms the outer and inner walls 48, 50, as well as the cooling chamber pins 62 and other airfoil component structures (such as the optional ribs 68). As will be understood by one skilled in the art, the cavities 88 can be filled with metal by any of a variety of other techniques.

Next, the ceramic shell is removed. The ceramic main and array cores 72, 74 are then leached out, such as by using an acid or acid mixture. This leaching process forms open areas that comprise the cavity 54, cooling chambers 52, inlets 58 and outlets 60. As will be understood by one skilled in the art, the main and array cores 72, 74 can be removed by any of a variety of techniques other than leaching.

Although this invention has been described in terms of a certain exemplary uses, preferred embodiment, and possible modifications thereto, other uses, embodiments and possible modifications apparent to those of ordinary skill in the art are also within the spirit and scope of this invention. It is also understood that various aspects of one or more features of this invention can be used or interchanged with various aspects of one or more other features of this invention. Accordingly, the scope of the invention is intended to be defined only by the claims that follow.

What is claimed is:

1. A method of manufacturing a closed loop steam cooled cast airfoil, comprising:

attaching an array core to a main core;

covering the main and array cores with wax to form a cast assembly;

removing the wax from the cast assembly to form cavities within the cast assembly having an intake from which the steam enters the airfoil and having an exhaust from where the steam exists the airfoil;

placing metal in the cavities; and removing the main and array cores to form the cast airfoil.

2. The manufacturing method of claim 1, wherein the array core is attached to the main core by at least one chaplet.

3. The manufacturing method of claim 1, wherein the array core is made from a ceramic slurry.

4. The manufacturing method of claim 1, wherein the array core has a plurality of holes that correspond in size and shape to pins used in an airfoil cooling chamber.

5. The manufacturing method of claim 1, wherein the main and array cores are covered by wax by injecting liquid wax around and between the main and array cores.

6. The manufacturing method of claim 1, wherein the wax is removed from the assembly by heating the assembly and allowing the melted wax to run-off from the assembly.

7. The manufacturing method of claim 1, wherein the metal is placed in the cavities by pouring liquid metal onto the assembly.

8. The manufacturing method of claim 1, wherein the main and array cores are removed from the assembly by an acid leaching technique.

9. The manufacturing method of claim 1, wherein a shell is placed around the wax before the wax is removed from the assembly, and the shell is removed from the assembly before the main and array cores are removed.

* * * * *